United States Patent [19]

Dreher et al.

[11] 4,212,370

[45] Jul. 15, 1980

[54] SOUND ABSORBER FOR AN INTERMITTENTLY DISCHARGED GASEOUS WORKING MEDIUM

[75] Inventors: Ernst Dreher, Reutlingen; Richard Wolf, Stuttgart; Max Bürklin, Waldenbuch, all of Fed. Rep. of Germany

[73] Assignee: Robert Bosch GmbH, Stuttgart, Fed. Rep. of Germany

[21] Appl. No.: 955,477

[22] Filed: Oct. 25, 1978

[30] Foreign Application Priority Data

Nov. 23, 1977 [DE] Fed. Rep. of Germany ..... 2752261

[51] Int. Cl.[2] ..... F01N 1/08

[52] U.S. Cl. ..... 181/230; 181/268; 181/272; 181/273; 181/276; 181/275

[58] Field of Search ..... 181/206, 230, 239, 251, 181/264–266, 268–270, 272, 276, 279–281, 273, 275; 173/DIG. 2

[56] References Cited

U.S. PATENT DOCUMENTS

| | | | |
|---|---|---|---|
| 2,926,745 | 3/1960 | Leistritz | 181/268 |
| 3,330,378 | 7/1967 | Waldron | 181/230 |
| 3,993,159 | 11/1976 | Amador | 181/230 |
| 4,042,062 | 8/1977 | Tooley | 181/230 |
| 4,068,987 | 1/1978 | Crooks | 181/230 |

*Primary Examiner*—L. T. Nix
*Assistant Examiner*—Benjamin R. Fuller
*Attorney, Agent, or Firm*—Michael J. Striker

[57] ABSTRACT

A sound absorber for intermittent exhaust gas, particularly for use in connection with a compressed air operated motor employed, for example, in a hand grinder. The sound absorber is arranged predominantly in the housing of the motor and includes an exhaust air discharging channel having an alternately varying cross-section to define a succession of continuously alternating narrow and wide passages for changing continuously the direction of flow of the exhaust air about an angle that is always lower than 90° with respect to the axis of the discharge channel so that the ratio of successive minimum and maximum cross-sections of the channel is at most 4:1. The discharge channel is terminated with a nozzle plate defining a plurality of outlet nozzles the central axes of which converge in the direction of flow. The discharge channel further includes at least one dead air space which in the case of a hand grinder is preferably formed by the interior of a hollow handle of the grinder and a portion of the discharge channel is divided by an air guiding partition into two partial conduits of different lengths and each communicating with one group of outlet nozzles.

12 Claims, 8 Drawing Figures

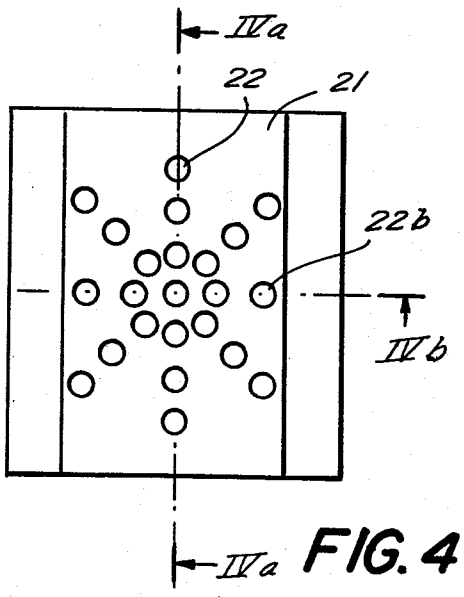
FIG. 4
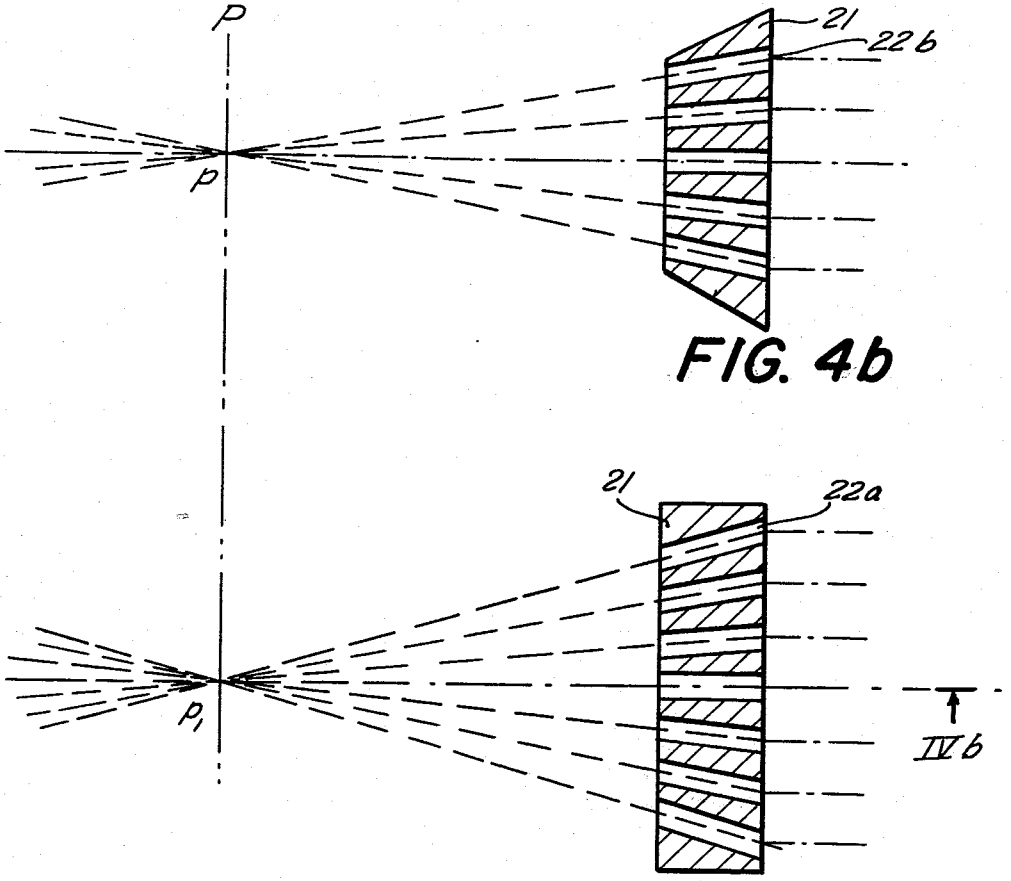
FIG. 4b
FIG 4a

SOUND ABSORBER FOR AN INTERMITTENTLY DISCHARGED GASEOUS WORKING MEDIUM

BACKGROUND OF THE INVENTION:

The invention relates generally to sound absorbers and more specifically it relates to a sound absorber or muffler for intermittently discharged gaseous working medium such as, for instance, compressed air discharged from a pneumatic rotary piston engine. Sound absorbers of this type have a discharge conduit including at least one portion in which the direction of flow of the discharged medium is changed and another portion defining a plurality of consecutively arranged overflow regions each having an alternatively varying cross-section. These known sound absorbers, however, in addition to continuously varying cross-section of one discharge conduit portion, have also abruptly varying overflow passages where irregular reductions and increases of the cross-section of the conduit and sharp deflections of the stream of the gaseous medium about 90° or even more, take place. This non-uniform guiding of the exhaust air contributes to the creation of partially desired vortexes which, however, counteract the sound absorbing effect.

Furthermore, in the known sound absorbers a small portion of the main exhaust air stream is branched through borings that are distributed in a radial and axial plane about a fraction of the wavelength of the vibrating air column in order to generate interference in the exhaust air stream. The small amounts of the branched air, however, can generate the desired interference only on a very limited scale and, therefore, they contribute to the total sound deadening only unsubstantially.

SUMMARY OF THE INVENTION

It is, therefore, a general object of the present invention to overcome the aforementioned disadvantages.

More particularly, it is an object of the invention to provide an improved sound absorber in which a substantial amount of the stream is a laminar stream which at the outlet part of the absorber is arranged into groups of beams of partial exhaust air streams so that a substantial smoothing of the exhaust air and thereby substantial absorption of noises is achieved.

In keeping with these objects, and others which will become apparent hereafter, one feature of the invention resides in the provision of a discharge conduit for the intermittent gaseous stream which has at least one portion in which the flow direction of the stream is changed and another portion defining a plurality of consecutively arranged overflow passages each of a continuously varying cross-section. According to another feature of this invention the changes of the direction of the gas stream occurring in the overflow passages of varying cross-sections are substantially smaller than 90° so that the ratio between the maximum and minimum cross-sections in the passages is at most 4:1 and there is also provided an outlet nozzle plate terminating the discharge conduit and defining a plurality of discharge nozzles the central axes of which converge in the direction of flow of the medium into the outer atmosphere.

In the modification of the sound absorber according to this invention, the points of cross-section of converging axes of the exhaust air outlet nozzles lie in a single plane. For predetermined loads and rotational speeds of the pneumatic rotary piston or cellular motor there are provided silence regions in the main discharge conduit that are formed by dead air spaces of different size. In the case of manually operated machines, one of such dead air spaces can be arranged in the handle of the machine. It is also possible to divide a portion of the main conduit in longitudinal direction into two partial conduits having approximately the same flow-through conditions but having different lengths whereby each partial conduit is assigned to a group of outlet nozzles so that the exhaust air stream is subject to an additional sound absorbing effect produced by interference.

Preferably, the discharge nozzles are arranged in groups whereby the center axes of the nozzles in each group intersect at one point and the resulting points of intersections are arranged in a line, or the outlet nozzles in each group are arranged in subgroups, whereby the center axes of the nozzles in each subgroup intersect at a single point, the points of intersection in one group being arranged in a line and all points of intersection being arranged in a plane which is perpendicular to the nozzle plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

FIG. **4*a* is a side section of the nozzle plate of FIG. 4** taken along the line IV*a*—IV*a*;

FIG. **4*b* is a side section of the nozzle plate of FIG. 4** taken along the line IV*b*—IV*b*;

FIGS. **4*c* and 4*d* are side sections similar to FIGS. 4*a* and 4*b*** and showing a modification of the nozzle plate.

Figure 1:
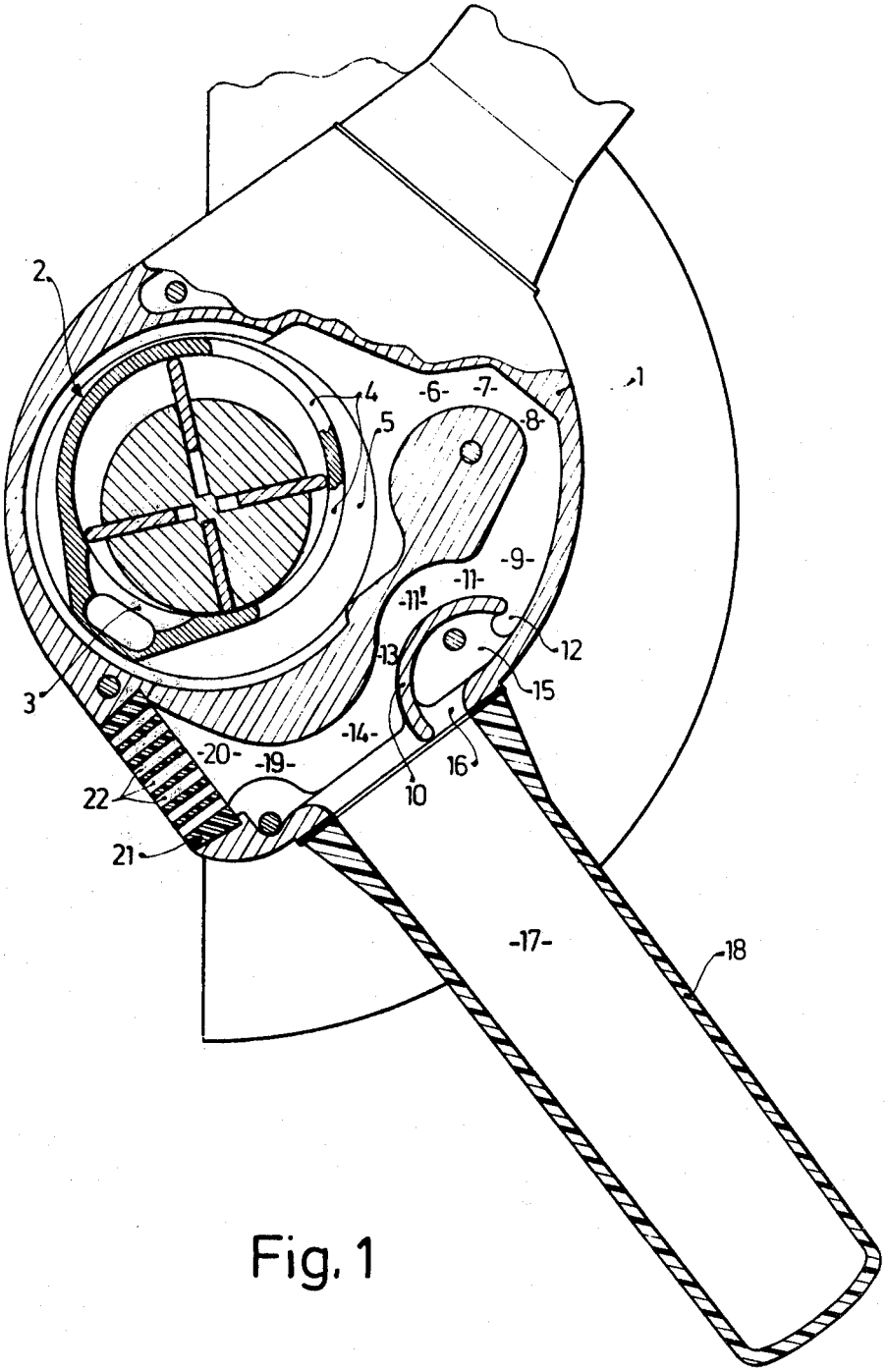
FIG. 1 is a cross-sectional side view of a sound absorbing arrangement of this invention having one dead air space and applied in connection with a compressed air hand grinder.

DESCRIPTION OF THE PREFERRED EMBODIMENTS:

The compressed air operated hand grinder as shown in FIG. 1 has a housing 1 and within the housing a pneumatic cellular or rotary piston motor 2. Compressed air acting as the gaseous working medium for the motor enters through inlet slots 3 the interior of the motor 2. Exhaust air leaves the motor through outlet slots 4. A discharge channel 5 communicates with the outlet slots 4 and in the region facing the outlet slots has a correspondingly increased cross-section which in the subsequent part of the channel 5 is reduced in size to form a narrow pass 6 then slightly increased to form a wider pass 7, then again constricted to form a narrow pass 8 and then again enlarged into a wide passage 9. In this passage, an air guiding partition 10 divides the channel 5 into two separate partial conduits each having a different width and each starting with a narrow pass 11 and 12. The narrow pass 11 extends into slightly wider passage 11' which again narrows into a narrow pass 13 and again is extended into a wide pass 14. The second partial conduit starting with the narrow pass 12 extends into a wide passage 15 which is again constricted in cross-section to form a narrow pass 16. The wide passage 14 of the first partial conduit and the narrow passage 16 of the second partial conduit communicate respectively with a dead air space 17 provided in the interior of a handle 18 connected to the housing 1 of the grinder. The wide passage 14 of the first partial conduit continues with a constricted or narrow pass 19 extending again into a wide pass 20 which is terminated with an outlet nozzle plate 21 provided with a plurality of nozzles or discharge holes 22 through which channel 5 communicates with the outer atmosphere. The nozzles 22 of the nozzle plate extend side-by-side to each other and their central axes converge in the direction of the discharge of the exhaust air into the atmosphere in such a manner that the axes of each two nozzles intersect at one point whereby the different points of intersection are arranged in a single plane which is perpendicular to the nozzle plate.

Figure 4D:
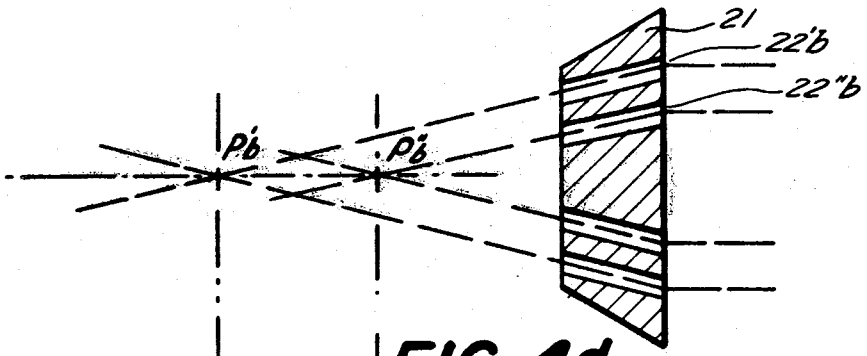
FIG. 4 is a plan view of the nozzle plate.
Figure 4C:
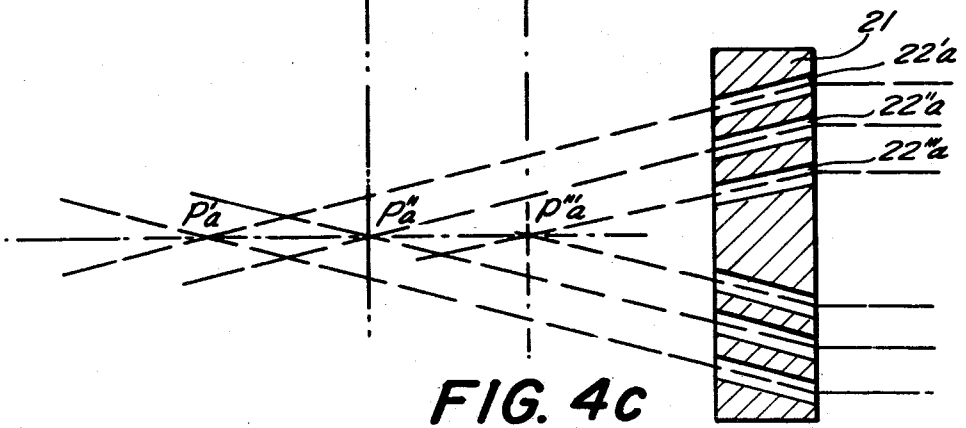

Preferably, the discharge nozzles are arranged in groups **22*a* and 22*b* whereby center axes of the nozzles in each group intersect at one point p (FIGS. 4*a* and 4*b*). In a modification (FIGS. 4*c* and 4*d*), the nozzles in each group are arranged in subgroups 22'*a*, 22''*a*, 22'''*a* and 22'*b*, 22''*b*** whereby the center axes of the nozzles in each subgroup intersect at a single point. The points of intersection in one group being arranged in a line and all points p'a, p''a, p'''a and p'b, p''b, of intersection being arranged in a plane.

Figure 2:
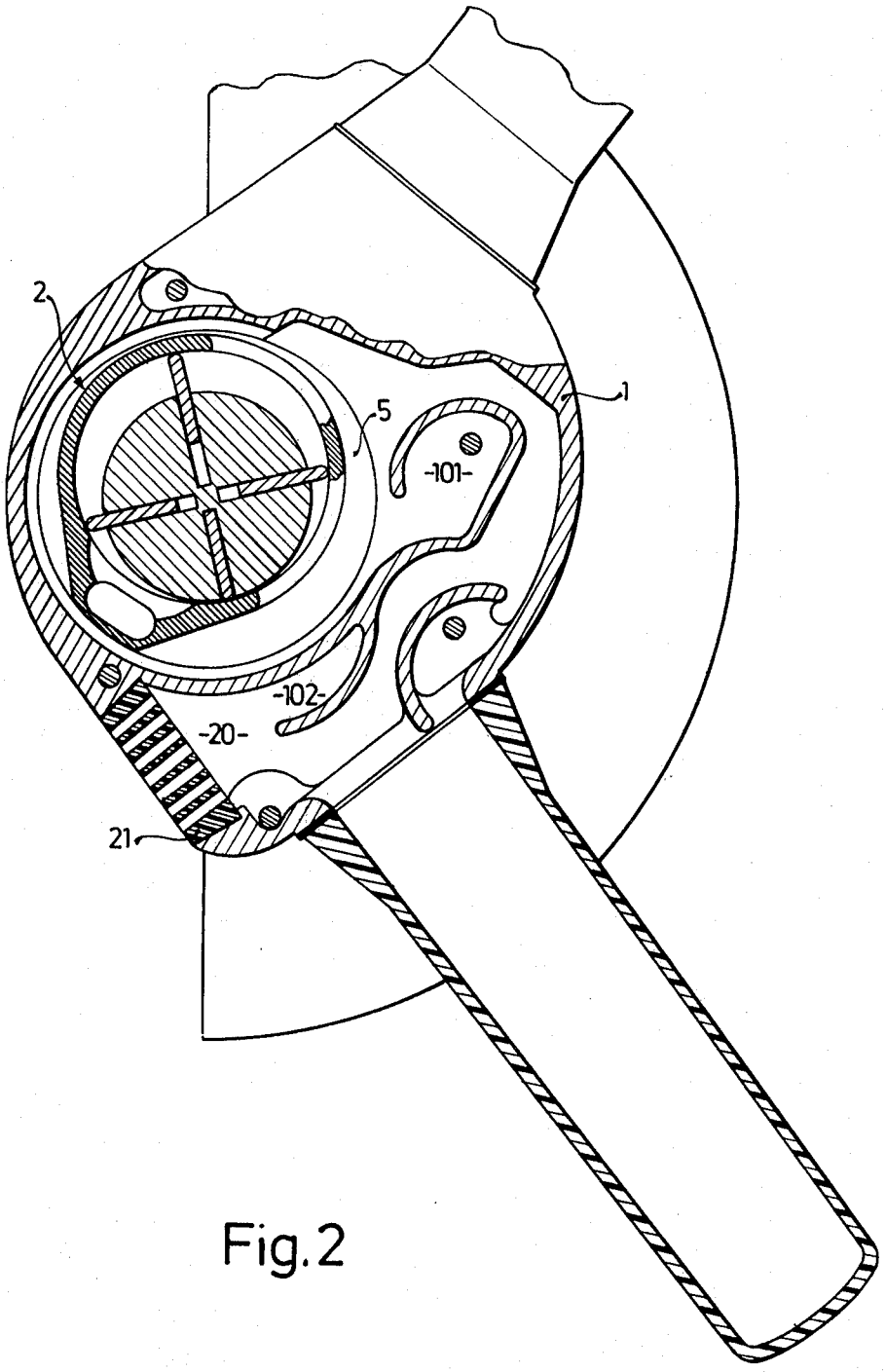
FIG. 2 is a modification of FIG. 1 showing a plurality of dead air spaces.

The compressed air grinder according to FIG. 2 corresponds substantially to that of FIG. 1 with the difference that the exhaust air discharging channel 5 communicates with an additional dead air space 101 the inlet opening of which faces the stream of exhaust air emanating from the motor 2 and the downstream portion of the channel 5 is provided with an additional dead air space 102 communicating with the terminal wide pass 20 in such a manner that the opening of the dead space 102 is reversed from the direction of streaming of the exhaust air.

Figure 3:
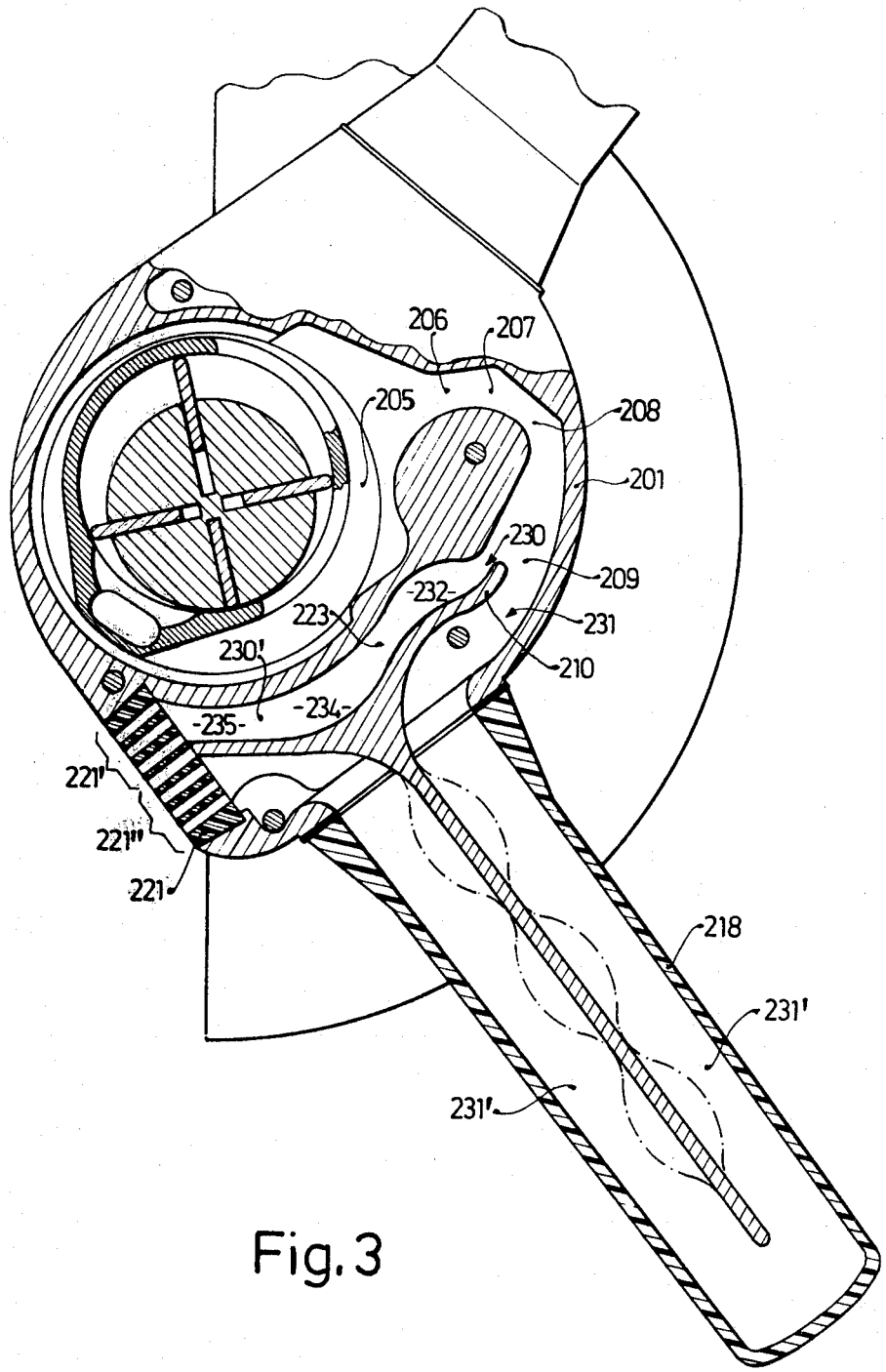
FIG. 3 is a modification of FIG. 1 without any dead air space but having an exhaust air discharge conduit divided into two partial conduits of non-uniform length.

In the embodiment of FIG. 3 of the compressed air operated hand grinder there is also provided an exhaust air discharging channel 205, a narrow pass 206, a wide pass 207, a narrow pass 208 and again a wide passage 209 arranged in similar points of the discharging channel of the sound absorber as in FIG. 1. After the wide passage 209, however, an air guiding partition 210 divides the discharging channel into two partial conduits, one having a narrow inlet pass 230 and the other a wider pass 231. The partition 210 extends into the interior of the hollow space formed in the handle 218 and divides the dead air space in the handle into a partial dead air space 231' continuing at the end portion of the interior of the handle with a parallel dead air space 231'; the partial conduit 230' starting with the narrow passage 230 forms in comparison with the other conduit a relatively short pass. The short partial conduit 230', as mentioned above, starts with a narrow passage 230, and continues with consecutively arranged wider passage 232, a narrow passage 223, a wider passage 234, and a narrow passage 235 terminating at one half 221' of the nozzle plate 221. The longer partial conduit 231' extends from the narrow passage 231 through a wider passage into the hollow handle 218 and terminates in the other half 221'' of the nozzle plate 221. As indicated by dash-dot lines, the part of the partition 210 extending within the handle 218 can be formed into an undulated shape so that it forms with the inner wall of the handle alternately narrowing and widening series of passages.

It will be understood that each of the elements described above, or two or more together, may also find a useful application in other types of constructions differing from the types described above.

While the invention has been illustrated and described as embodied in a sound absorber for use with a compressed air operated hand grinder, it is not intended to be limited to the details shown, since various modifications and structural changes may be made without departing in any way from the spirit of the present invention. For example, according to the employed rotational speed of the cellular motor, and according to the pressure of the compressed air, or in response to the frequency and to the energy of the pulses of the exhaust air, it is possible to combine the modifications shown in respective examples of the preferred embodiments so as to attain the maximum sound-deadening effect.

What is claimed as new and desired to be protected by Letters Patent is set forth in the appended claims.

1. A sound absorber for intermittently discharged gaseous working medium, comprising a discharge channel for said medium, said channel having at least one portion in which the direction of flow of said medium is changed and said one portion defining a succession of passages periodically increasing and decreasing in cross-section; the variations of the flow direction of said medium in respective passages being substantially smaller than 90°, and the ratio between the maximum and minimum cross-sections of said passages being at most 4:1; and an outlet nozzle plate terminating said discharge channel and defining a plurality of discharge nozzles having central axes converging in the direction of flow of said medium into the outer atmosphere and at least a part of said central axes intersecting at different points lying in a single plane.

2. A sound absorber as defined in claim 1, wherein the axes of all discharge nozzles are directed to a single point.

3. A sound absorber as defined in claim 1, wherein said plane of intersecting points extends in the direction of the discharged stream.

4. A sound absorber as defined in claim 3, wherein said plane of intersecting points is perpendicular to said nozzle plate.

5. A sound absorber as defined in claim 1, wherein said discharge channel communicates with at least one dead air space.

6. A sound absorber as defined in claim 5, having at least two dead spaces of different size.

7. A sound absorber as defined in claim 1, wherein said discharge channel communicates with discharge openings of a hand-operated compressed air motor having a housing, said discharge channel and said flow direction changing portion thereof being arranged in said housing.

8. A sound absorber as defined in claim 7, wherein a hollow handle is connected to said housing and the inner space of said handle communicates with said discharge channel to form a dead air space for said stream of said medium.

9. A sound absorber as defined in claim 8, wherein a portion of said discharge channel includes an air guiding partition dividing said portion into two partial conduits having different lengths, the shorter of said partial conduits communicating with a group of outlet nozzles in said nozzle plate, and the longer partial conduit communicating with another group of said nozzles.

10. A sound absorber as defined in claim 9, wherein said partition branches into said dead air space in said handle and said longer partial conduit passing through said dead space around said branched partition.

11. A sound adsorber for intermittently discharged gaseous working medium, comprising a discharge channel for said medium, said channel having at least one portion in which the direction of flow of said medium is changed and said one portion defining a succession of passages periodically increasing and decreasing in cross-section; the variations of the flow direction of said medium in respective passages being substantially smaller than 90°, and the ratio between the maximum and minimum cross-sections of said passages being at most 4:1, and an outlet nozzle plate terminating said discharge channel and defining a plurality of discharge nozzles having central axes converging in the direction of flow of said medium into the outer atmosphere and at least a part of said central axes intersecting at one point.

12. A sound absorber as defined in claim 11, wherein said dischare nozzles are arranged in groups whereby the center axes of said nozzles in each group intersect at one point and the resulting points of intersections are arranged in a line.

* * * * *